US008162681B2

(12) United States Patent
Huang et al.

(10) Patent No.: US 8,162,681 B2
(45) Date of Patent: Apr. 24, 2012

(54) ELECTRONIC DEVICE USING EARPHONE JACK ASSEMBLY

(75) Inventors: Lucas Huang, Shenzhen (CN); Lee-Han Ng, Shenzhen (CN); Chien-Chun Huang, Taipei Hsien (TW)

(73) Assignee: FIH (Hong Kong) Limited, Kowloon (HK)

( * ) Notice: Subject to any disclaimer, the term of this patent is extended or adjusted under 35 U.S.C. 154(b) by 430 days.

(21) Appl. No.: 12/506,358

(22) Filed: Jul. 21, 2009

(65) Prior Publication Data

US 2010/0144208 A1 Jun. 10, 2010

(30) Foreign Application Priority Data

Dec. 4, 2008 (CN) ..... 2008 1 0305953

(51) Int. Cl.
*H01R 13/44* (2006.01)

(52) U.S. Cl. ..... 439/131; 439/668; 320/114

(58) Field of Classification Search ..... 439/131, 439/668, 944; 320/114; 361/697.1
See application file for complete search history.

(56) References Cited

U.S. PATENT DOCUMENTS

| | | | | |
|---|---|---|---|---|
| 4,986,762 | A * | 1/1991 | Keith | 439/131 |
| 5,919,052 | A * | 7/1999 | Ho | 439/83 |
| 6,611,697 | B1 * | 8/2003 | Ewing et al. | 455/575.1 |
| 2009/0109555 | A1 * | 4/2009 | Mashima et al. | 359/823 |
| 2010/0231458 | A1 * | 9/2010 | Koyama | 343/702 |

FOREIGN PATENT DOCUMENTS

JP 2005093219 A 4/2005

* cited by examiner

*Primary Examiner* — Hien Vu
(74) *Attorney, Agent, or Firm* — Altis Law Group, Inc.

(57) ABSTRACT

An electronic device includes a first housing, a second housing latching to the first housing, a resilient component assembled to the second housing, and an earphone jack assembly. The second housing includes a first plate comprising a latching portion; and a resilient component assembled on the second housing. The earphone jack assembly includes a base latching to the latching portion, compressing the resilient component and rotatably assembled to the first housing and the second housing.

16 Claims, 6 Drawing Sheets

ELECTRONIC DEVICE USING EARPHONE JACK ASSEMBLY

BACKGROUND

1. Field of the Invention

The present disclosure relates to an electronic device using an earphone jack assembly.

2. Description of Related Art

Currently, electronic devices, such as mobile phones, radios, electronic dictionaries usually have an earphone jack assembly. An earphone plug can be inserted into the earphone jack assembly to transfer sound frequency signals to an earphone.

Typically, the earphone jack assembly is secured in an electronic device. When a headset plug of the headphone is inserted into the earphone jack assembly, the headset plug perpendicularly extends from the electronic device. Thus, the headset plug can easily be bent. In addition, the earphone jack assembly is exposed from the electronic device, the dust or water may easily enter the earphone jack assembly, thereby damaging the earphone jack assembly.

Therefore, there is room for improvement within the art.

BRIEF DESCRIPTION OF THE DRAWINGS

Many aspects of an electronic device using earphone jack assembly can be better understood with reference to the following drawings. The components in the drawings are not necessarily to scale, the emphasis instead being placed upon clearly illustrating the principles of the present electronic device using earphone jack assembly. Moreover, in the drawings, like reference numerals designate corresponding parts throughout the several views.

DETAILED DESCRIPTION OF THE EXEMPLARY EMBODIMENTS

Figure 1:
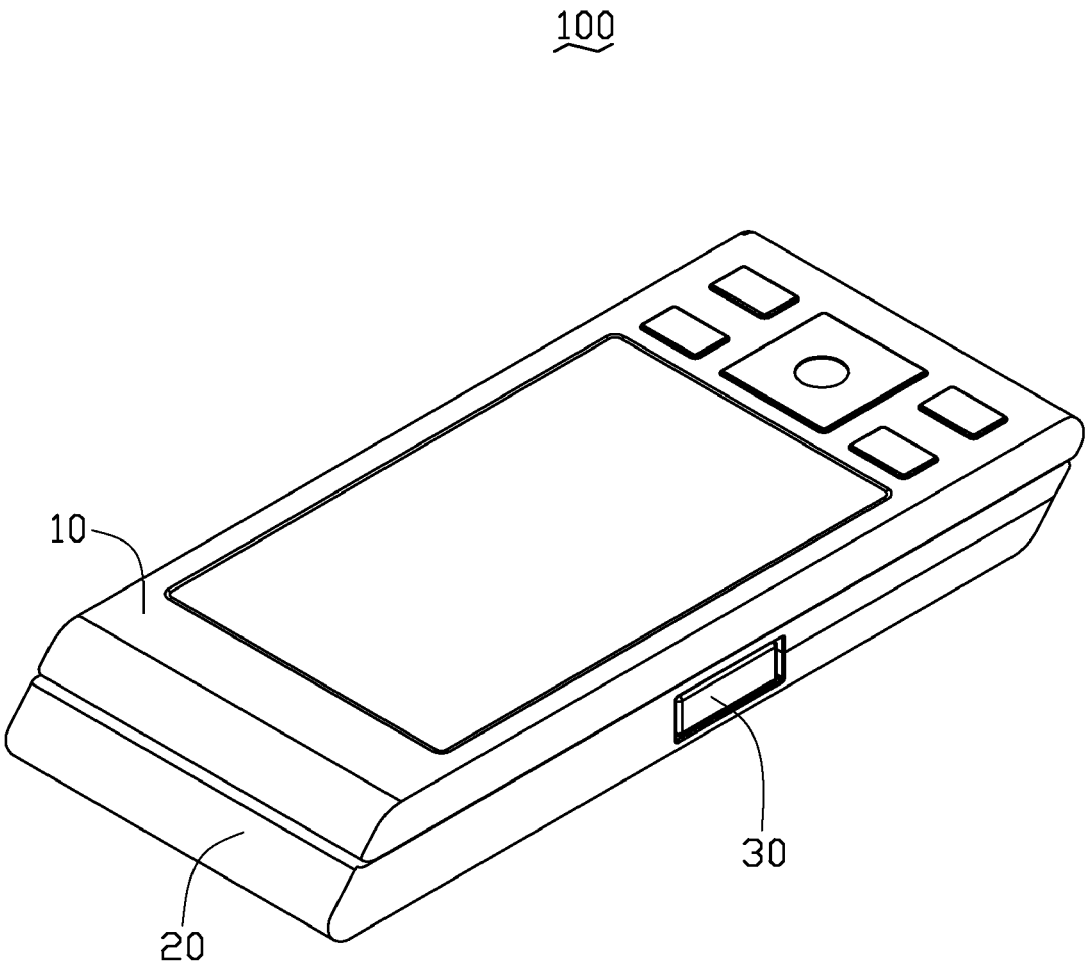
FIG. 1 is a schematic, assembled view of an electronic device according to an exemplary embodiment.
Figure 2:
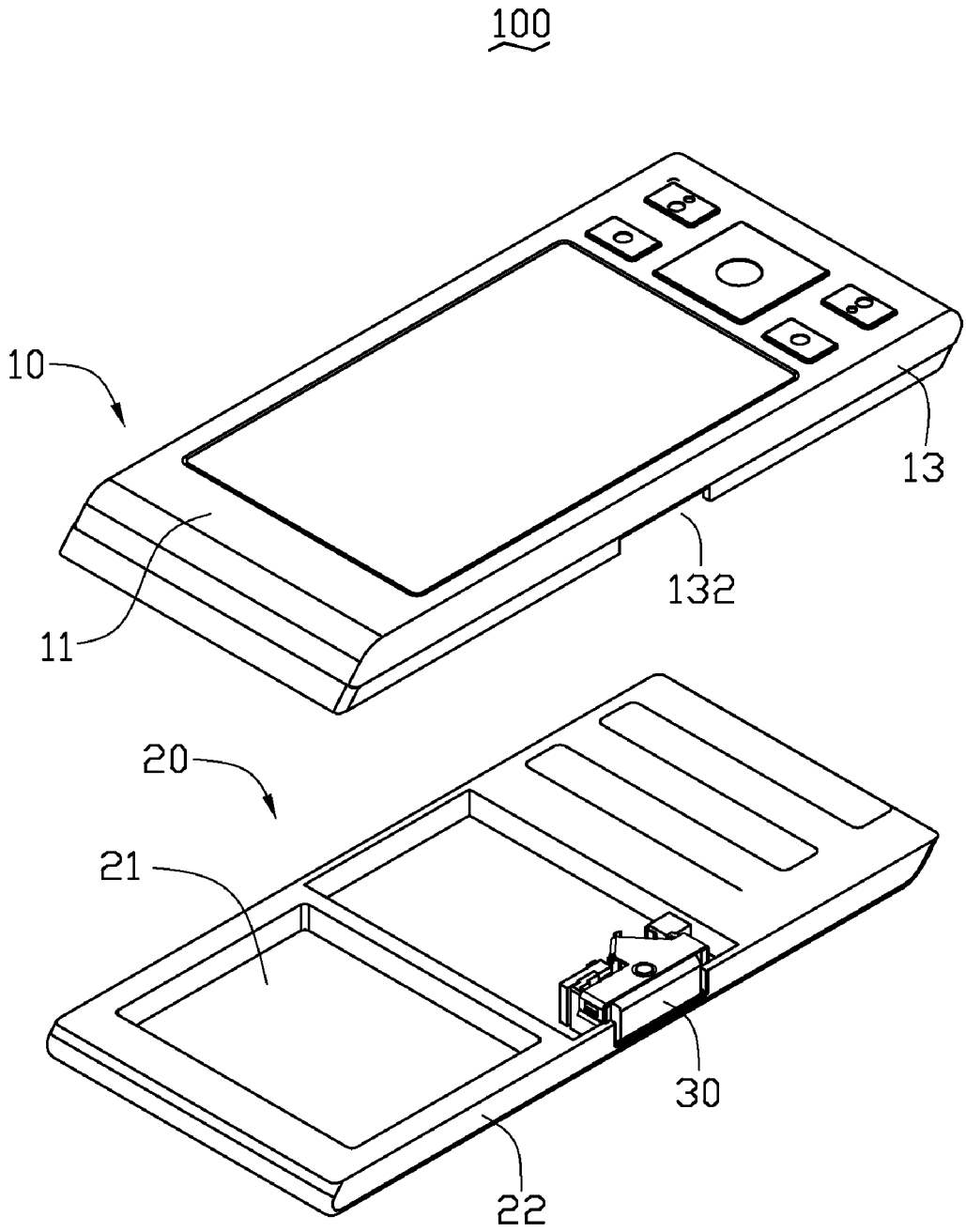
FIG. 2 is a schematic, exploded view of the electronic device shown in FIG. 1.

Referring to FIGS. 1 and 2, in an exemplary embodiment, an earphone jack assembly 30 is used in an electronic device, such as a mobile phone 100. The mobile phone 100 includes a first housing 10, a second housing 20 latching to the first housing 10, and the earphone jack assembly 30 is between the first housing 10 and the second housing 20.

The first housing 10 includes a main housing 11 and two sidewalls 13 facing each other. One of the sidewalls 13 defines a first opening 132.

Figure 3:
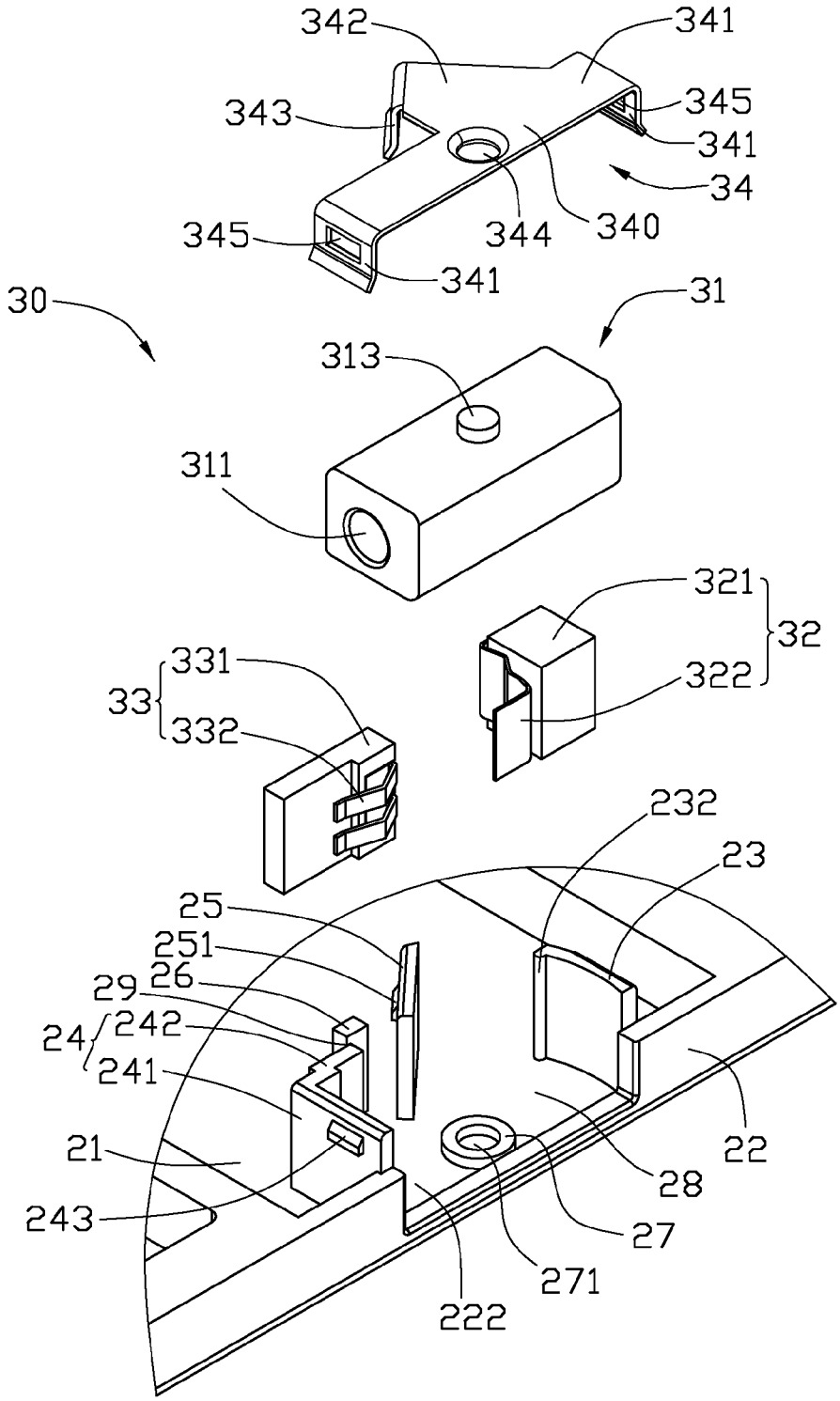
FIG. 3 is an exploded, enlarging a portion of an earphone jack assembly in the electronic device shown in FIG. 2.
Figure 4:
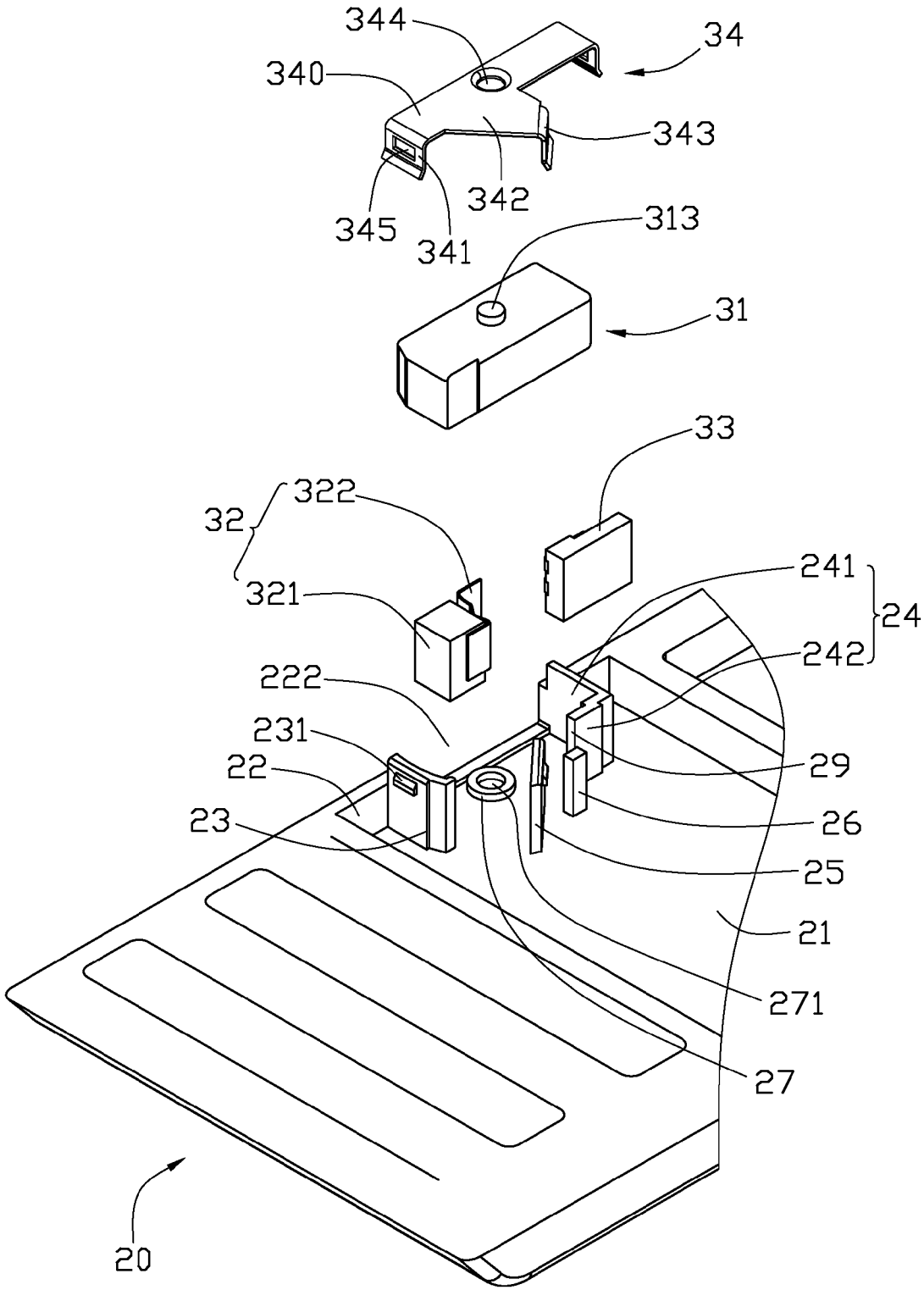
FIG. 4 is a similar to FIG. 3, but viewed from another aspect.

Referring to FIGS. 3 and 4, the second housing 20 includes a bottom wall 21 and a peripheral wall 22 perpendicular away from the bottom wall 21. One of the peripheral walls 22 defines a second opening 222. The bottom wall 21 includes a first plate 23, a second plate 24, a third plate 25, a post 26, and a protrusion 27 respectively positioned thereon. The first plate 23 perpendicularly connects to the peripheral wall 22 adjacent to the second opening 222. The first plate 23 includes a first clasp 231 positioned on a side thereof and a latching portion 232 positioned on an end thereof. The latching portion 232 is positioned on an opposite side of the first plate 23 to the first clasp 231. The second plate 24 includes a main body 241, an extending plate 242, and a second clasp 243. The main body 241 is L-shaped. An end of the main body 241 perpendicularly connects to the peripheral wall 22. The extending plate 242 extends from the other end of the main body 241 and parallels to the peripheral wall 22. The second clasp 243 is positioned on a side of the main body 241 opposite to the first plate 23. The third plate 25 is positioned between the first plate 23 and the second plate 24. The third plate 25 and the peripheral wall 22 define an included angle therebetween. The third plate 25 includes a third clasp 251 positioned on a side thereof opposite to the first plate 23. The third plate 25 is configured for limiting rotating angle of the earphone jack assembly 30. The post 26 is positioned adjacent to the extending plate 242, and defines a gap 29 between the post 26 and the extending plate 242. The first plate 23, the second plate 24, the third plate 25, and the second housing 20 cooperatively define a receiving portion 28 for receiving the earphone jack assembly 30. The protrusion 27 is positioned in the receiving portion 28. The protrusion 27 defines a blind hole 271.

The earphone jack assembly 30 includes a base 31, a conductive component 32, a resilient component 33 assembled on the second housing 20, and a cover 34. The base 31 includes a jack 311 and two rotating shafts 313. The jack 311 is defined in an end of the base 31. The rotating shafts 313 are symmetrically positioned at two opposite sides of the base 31. One of the rotating shafts 313 is rotatably received in the blind hole 271. The conductive component 32 includes a conductive block 321 and a conductive sheet 322 connecting to the conductive block 321. The conductive block 321 is positioned on the bottom wall 21 and configured for electronically connecting to a printed circuit board. The conductive sheet 322 is flexible and electronically connects to the base 31. The resilient component 33 includes a main plate 331 and two resilient pieces 332. The main plate 331 is latched in the gap 29. The resilient pieces 332 are V-shaped, an end of each of the resilient pieces 332 is positioned on the main plate 331, the other end of the each of the resilient pieces 332 resists the main plate 331. The resilient pieces 332 are configured for providing elastic force to the base 31. The cover 34 is a single sheet plate, and includes a cover body 340, and an extending portion 342 extending from one side of the cover body 340. Each end of the cover body 340 perpendicularly has two first cover sheets 341 and the extending portion 342 has a second cover sheet 343. The cover 34 defines a through hole 344 for receiving the rotating shafts 313. The first cover sheets 341 and second cover sheet 343 each defines a latching hole 345 matchable with a corresponding one of the first clasp 231, the second clasp 243, and the third clasp 251.

Figure 5:
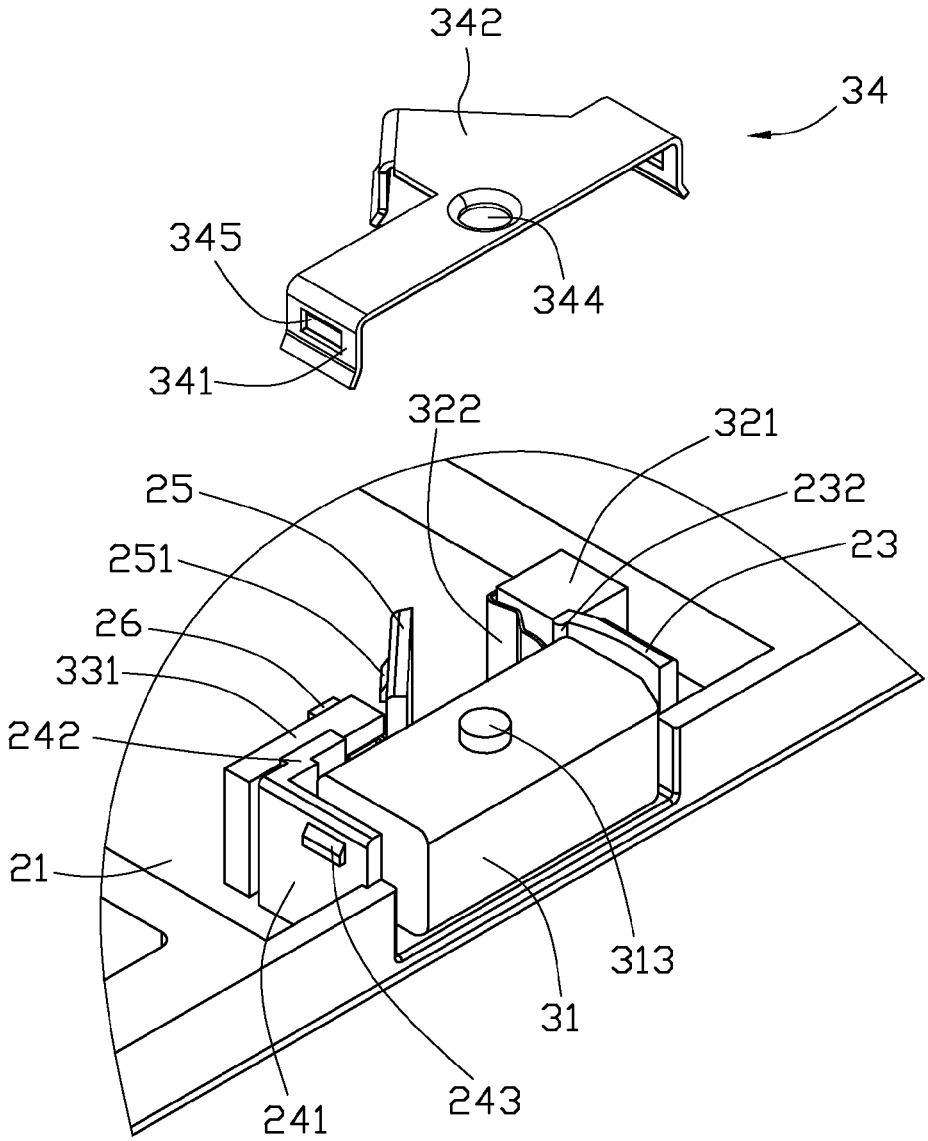
FIG. 5 is a schematic view of the earphone jack assembly assembled in the electronic device.
Figure 6:
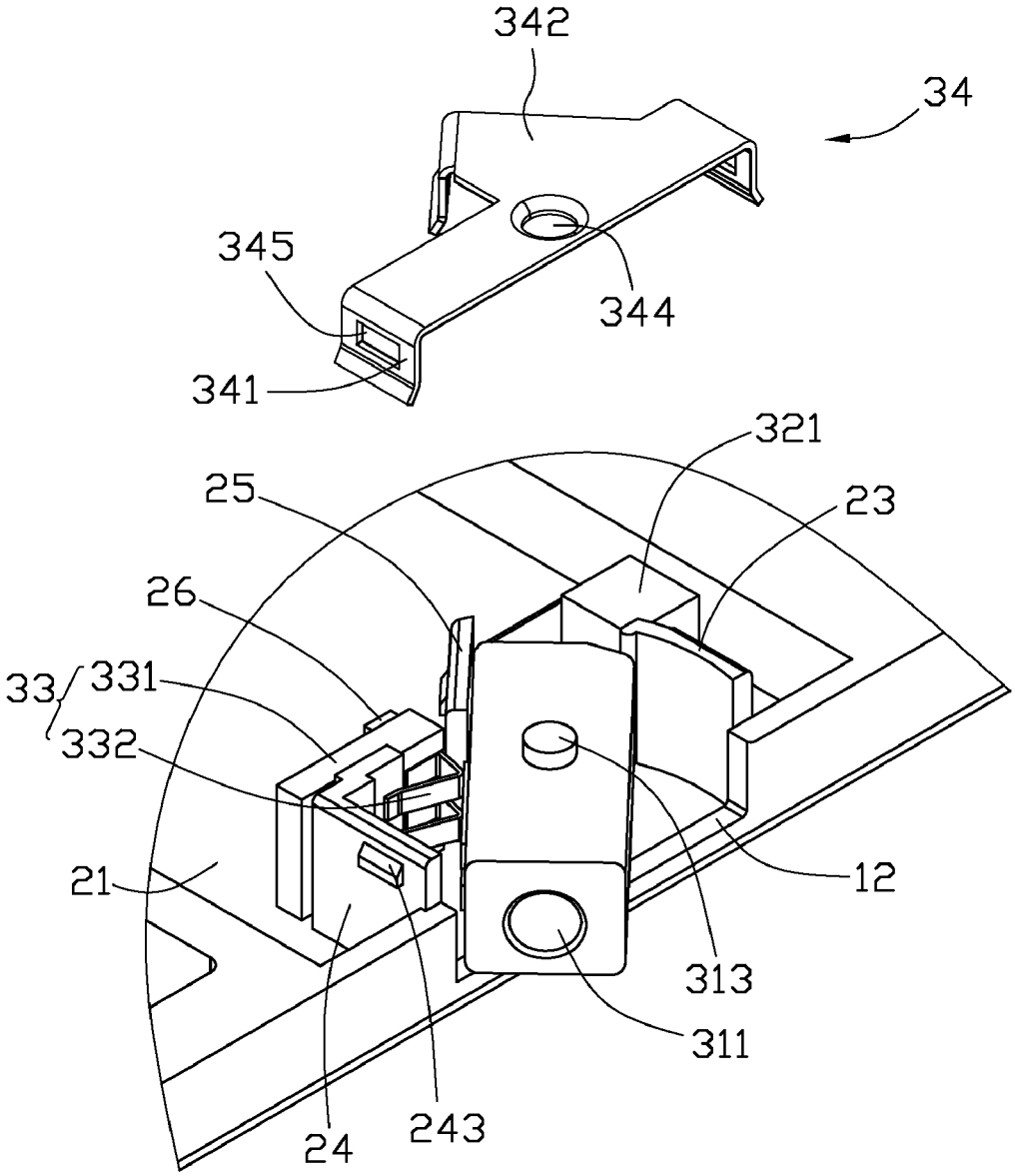
FIG. 6 is a schematic view of the earphone jack assembly rotated out of the electronic device.

Referring to FIG. 5 and FIG. 6, in assembly, the main plate 331 is latched in the gap 29. The resilient pieces 332 latch to the extending plate 242. One of the rotating shafts 313 is inserted into the blind hole 271 of the protrusion 27. The base 31 is received in the receiving portion 28 and compresses the resilient pieces 332, and then resists the second plate 24. The base 31 latches to the latching portion 232. Therefore, the base 31 is secured in the receiving portion 28 relative to the second housing 20. The cover 34 covers the base 31. The first cover sheets 341 and the second cover sheet 343 respectively latch to the first clasp 231, the second clasp 243, and the third clasp 251. Meanwhile, one of the rotating shafts 313 is inserted into the through hole 344. The first housing 10 is finally assembled on the second housing 20. The base 31 is exposed from the first opening 132 and the second opening 222.

In used, the base 31 is pushed by an external force. The base 31 is detached from the latching portion 232, and rotates in the receiving portion 28. The resilient pieces 332 resist the base 31, and the base 31 resists the third plate 25. Thereby, the jack 311 is exposed from the mobile phone 100.

When closing the base 31, the base 31 is pushed by an external force, the end defining the jack 311 rotates into the mobile phone 100. The base 31 compresses the resilient pieces 332, and latches to the latching portion 232. Thereby, the base 31 is secured in the receiving portion 28 relative to the mobile phone 100.

The earphone jack assembly 30 is rotatably assembled in the mobile phone 100, dust or water can not enter the earphone jack assembly 30. Thereby, the jack 311 can be protected by the mobile phone 100.

It is to be understood, the cover 34 can be omitted, the base 31 directly resists the first housing 10.

It is to be understood, the third plate 25 can be omitted, the resilient pieces 332 is configured for limiting rotating angle of the base 31.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electronic device, comprising:

a first housing having a bottom wall;

a second housing assembled to the first housing, and comprising:

a first plate extended upwardly from the bottom wall comprising a latching portion positioned thereon; and a resilient component assembled on the second housing, the resilient component comprises a main plate and at least one resilient piece secured on the main plate;

an earphone jack assembly comprising a base latching to the latching portion, and the base compressing the resilient component and rotatably assembled to the first housing and the second housing;

wherein the base comprises a first rotating shaft positioned thereon, the second housing defines a blind hole, the first rotating shaft is rotatably received in the blind hole.

2. The electronic device as claimed in claim 1, wherein the second housing further comprises a second plate opposite to the first plate and a post, the main plate latches between the post and the second plate, the resilient piece latches to the second plate, and resists the base.

3. The electronic device as claimed in claim 2, wherein the resilient piece is V-shaped, one end of the resilient piece is secured on the main plate, the resilient piece is configured for providing an elastic force to the base.

4. The electronic device as claimed in claim 2, wherein the second housing further comprises a third plate positioned between the first plate and the second plate, third plate is configured for limiting rotating angle of the base.

5. The electronic device as claimed in claim 4, wherein the earphone jack assembly further comprises a cover latching to the first plate, the second plate and the third plate, the cover is configured for covering the base on the second housing.

6. The electronic device as claimed in claim 5, wherein the cover comprises a cover body and an extending portion extending from one side of the cover body, each end of the cover body perpendicularly has two first cover sheets and the extending portion has a second cover sheet, the first cover sheets and the second cover sheet respectively latch to the first plate, the second plate and the third plate.

7. The electronic device as claimed in claim 6, wherein the cover defines a through hole, the base comprises a second rotating shaft positioned on an opposite side of the base to the first rotating shaft, the second rotating shaft is rotatably received in the through hole.

8. The electronic device as claimed in claim 6, wherein the first plate, the second plate and the third plate respectively comprise a clasp positioned thereon, each of the first cover sheets and the second cover sheet defines a latching hole, each clasp latches in the latching hole.

9. An electronic device, comprising:

a housing having a bottom wall, comprising:

a first plate extended upwardly from the bottom wall comprising a latching portion positioned thereon; and a resilient component assembled in the housing, the resilient component comprises a main plate and at least one resilient piece secured on the main plate;

an earphone jack assembly comprising a base latching to the latching portion, and the base compressing the resilient component and rotatably assembled to the housing; and a cover covering the base in the housing;

wherein the base comprises a first rotating shaft positioned thereon, the housing comprises a bottom wall defining a blind hole, the first rotating shaft is rotatably received in the blind hole.

10. The electronic device as claimed in claim 9, wherein the housing further comprises a second plate opposite to the first plate and a post, the main plate latches between the post and the second plate, the resilient piece latches to the second plate, and resists the base.

11. The electronic device as claimed in claim 10, wherein the resilient piece is V-shaped, one end of the resilient piece is secured on the main plate, the resilient piece is configured for providing an elastic force to the base.

12. The electronic device as claimed in claim 10, wherein the housing further comprises a third plate positioned between the first plate and the second plate, third plate is configured for limiting rotating angle of the base.

13. The electronic device as claimed in claim 10, wherein the cover latching to the first plate, the second plate and the third plate, the cover is configured for covering the base in the housing.

14. The electronic device as claimed in claim 13, wherein the cover comprises a cover body and an extending portion extending from one side of the cover body, each end of the cover body perpendicularly has two first cover sheets and the extending portion has a second cover sheet, the first cover sheets and the second cover sheet respectively latch to the first plate, the second plate and the third plate.

15. The electronic device as claimed in claim 14, wherein the cover defines a through hole, the base comprises a second rotating shaft positioned on an opposite side of the base to the first rotating shaft, the second rotating shaft is rotatably received in the through hole.

16. The electronic device as claimed in claim 14, wherein the first plate, the second plate and the third plate respectively comprise a clasp positioned thereon, each of the first cover sheets and the second cover sheet defines a latching hole, each clasp latches in the latching hole.

* * * * *